US010162281B2

(12) United States Patent
Tsuchida et al.

(10) Patent No.: US 10,162,281 B2
(45) Date of Patent: Dec. 25, 2018

(54) LIQUID DEVELOPER AND MANUFACTURING METHOD OF LIQUID DEVELOPER

(71) Applicant: CANON KABUSHIKI KAISHA, Tokyo (JP)

(72) Inventors: Naohiko Tsuchida, Tokyo (JP); Yasutaka Akashi, Yokohama (JP); Yuzo Tokunaga, Chiba (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/628,708

(22) Filed: Jun. 21, 2017

(65) Prior Publication Data

US 2017/0371260 A1 Dec. 28, 2017

(30) Foreign Application Priority Data

Jun. 27, 2016 (JP) ..... 2016-127028
Jun. 27, 2016 (JP) ..... 2016-127032

(51) Int. Cl.

| | |
|---|---|
| ***G03G 9/12*** | (2006.01) |
| ***G03G 9/135*** | (2006.01) |
| ***G03G 9/13*** | (2006.01) |
| *G03G 15/10* | (2006.01) |

(52) U.S. Cl.

CPC ..... *G03G 9/122* (2013.01); *G03G 9/132* (2013.01); *G03G 9/135* (2013.01); *G03G 9/1355* (2013.01); *G03G 15/10* (2013.01)

(58) Field of Classification Search

CPC ..... G03G 9/12; G03G 9/0904; G03G 15/10; G03G 9/0827; G03G 9/08784

See application file for complete search history.

(56) References Cited

U.S. PATENT DOCUMENTS

| | | | |
|---|---|---|---|
| 4,904,562 | A | 2/1990 | Yusa et al. |
| 5,212,524 | A | 5/1993 | Tanikawa et al. |
| 5,215,854 | A | 6/1993 | Yamakazi et al. |
| 5,268,248 | A | 12/1993 | Tanikawa et al. |
| 5,296,326 | A | 3/1994 | Taya et al. |
| 5,338,894 | A | 8/1994 | Uchiyama et al. |
| 5,348,829 | A | 9/1994 | Uchiyama et al. |
| 5,480,755 | A | 1/1996 | Uchiyama et al. |
| 5,500,318 | A | 3/1996 | Tanikawa et al. |
| 5,573,880 | A | 11/1996 | Mayama et al. |
| 5,641,600 | A | 6/1997 | Kotaki et al. |
| 5,712,069 | A | 1/1998 | Baba et al. |
| 5,766,814 | A | 6/1998 | Baba et al. |
| 6,083,655 | A | 7/2000 | Itabashi et al. |

(Continued)

FOREIGN PATENT DOCUMENTS

| | | | |
|---|---|---|---|
| CA | 2772942 | * | 3/2012 |
| JP | 2003-241439 | | 8/2003 |

(Continued)

*Primary Examiner* — Thorl Chea
(74) *Attorney, Agent, or Firm* — Venable LLP

(57) ABSTRACT

A liquid developer comprising a toner particle containing a binder resin and a carbon black, a toner particle dispersing agent, and a carrier liquid, wherein amounts of group 15 elements, group 16 elements, and group 17 elements on a surface of the carbon black are respectively 0.1 atomic percent or less with respect to a total amount of elements on the carbon black surface.

3 Claims, 1 Drawing Sheet

(56) References Cited

U.S. PATENT DOCUMENTS

| | | | | |
|---|---|---|---|---|
| 6,106,990 | A | 8/2000 | Tazawa et al. | |
| 6,120,957 | A * | 9/2000 | Miyamoto | G03G 9/13 430/108.21 |
| 6,159,648 | A | 12/2000 | Baba et al. | |
| 6,165,663 | A | 12/2000 | Baba et al. | |
| 6,566,028 | B2 | 5/2003 | Tazawa et al. | |
| 6,632,577 | B2 | 10/2003 | Akashi et al. | |
| 7,361,442 | B2 | 4/2008 | Otake et al. | |
| 7,796,926 | B2 | 9/2010 | Matsuda et al. | |
| 8,538,303 | B2 | 9/2013 | Matsuda et al. | |
| 9,158,217 | B2 | 10/2015 | Takahashi et al. | |
| 9,703,216 | B2 | 7/2017 | Tsuchida et al. | |
| 2003/0232185 | A1 | 12/2003 | Shimamura et al. | |
| 2011/0274467 | A1 * | 11/2011 | Takayama | C08F 12/28 399/252 |
| 2014/0004460 | A1 | 1/2014 | Yoshiba et al. | |
| 2014/0087305 | A1 * | 3/2014 | Yamada | G03G 9/122 430/115 |
| 2015/0220013 | A1 | 8/2015 | Nishikawa et al. | |

FOREIGN PATENT DOCUMENTS

| | | | |
|---|---|---|---|
| JP | 003584160 | B2 * | 11/2004 |
| JP | 2005-115244 | | 4/2005 |
| JP | 2011-128388 | | 6/2011 |
| WO | 2006/126566 | | 11/2006 |
| WO | 2007/000974 | | 1/2007 |
| WO | 2007/000975 | | 1/2007 |
| WO | 2007/108485 | | 9/2007 |

* cited by examiner

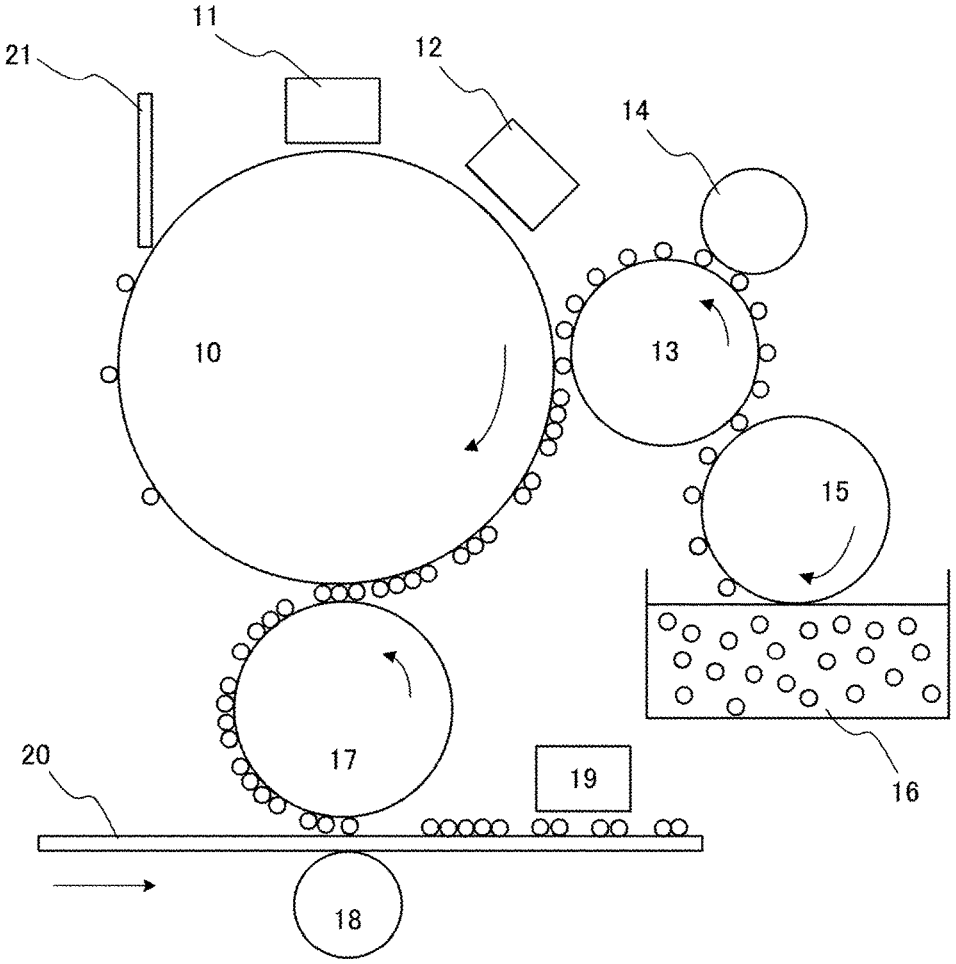
11
12
21
14
10
13
15
16
17
19
20
18

LIQUID DEVELOPER AND MANUFACTURING METHOD OF LIQUID DEVELOPER

BACKGROUND OF THE INVENTION

Field of the Invention

The present invention relates to a liquid developer used in an image forming apparatus utilizing an electrophotographic system and to a manufacturing method of the liquid developer.

Description of the Related Art

In recent years, among image forming apparatuses utilizing an electrophotographic system, high-speed digital printing apparatuses with high image quality utilizing a wet developing system which offers an advantage in terms of high-speed image formation are garnering attention.

The wet developing system uses a liquid developer in which a toner particle is dispersed in a carrier liquid. Compared to developers used in a dry developing system, a finer toner particle can be used. Therefore, the wet developing system is superior to the dry developing system in terms of dot image reproducibility and gradation reproducibility.

However, there are demands for a finer toner particle than before in order to meet recent needs for higher image quality. Generally, the finer the particles dispersed in a liquid, the more likely aggregation between the particles occur. Therefore, simply dispersing a toner particle in a liquid developer using a dispersing agent does not eliminate the risk of aggregation of the toner particle in the liquid developer during long-term storage. Since performing printing using a toner particle having aggregated in the liquid in this manner may inhibit superior dot image reproducibility which is a feature of the wet developing system, the development of a toner particle which does not aggregate even during long-term storage is considered important. In particular, in the case of a toner particle containing carbon black which is a black pigment, since carbon black itself is characteristically readily aggregable, there is a tendency that aggregation of the toner particle readily occurs.

In addition, recently, material design aimed at increasing reactivity between a binder resin and a dispersing agent has become mainstream. When using carbon black as a pigment, there are cases where the carbon black is not encapsulated in the binder resin due to interaction between the dispersing agent and the carbon black. When a material with low volume resistance such as carbon black exists in a free state in a liquid developer instead of being encapsulated in the binder resin, the carbon black may act as a leakage site of charges and cause a decline in image density or image density non-uniformity. Furthermore, there is also a concern that faulty cleaning may occur.

The dispersibility of a toner particle in a liquid developer has been conventionally discussed and, as a countermeasure, Japanese Patent Application Laid-open No. 2005-115244 discloses using a dispersing agent with pH of 4 or lower and constituted by carbon black and modified silicone to increase toner dispersibility in a liquid. In addition, Japanese Patent Application Laid-open No. 2011-128388 discloses improving dispersibility of a toner particle by using halogenated alkylalkoxysilane as a dispersing agent. However, neither patent document makes any reference to long-term storage. Furthermore, there is also no reference to the possibility that interaction between a dispersing agent and carbon black may impair encapsulation behavior of the carbon black.

SUMMARY OF THE INVENTION

As described above, several inventions which take the dispersibility of a toner particle in a liquid developer into consideration have been disclosed. However, none of the inventions particularly describe the encapsulation behavior of carbon black or cases where a liquid developer using a toner particle containing carbon black is stored over a long period of time and, as things stand, there is room for further improvement.

Accordingly, in consideration of the situations described above, an object of the present invention is to provide a liquid developer which uses a toner particle containing a carbon black and which is capable of suppressing aggregation of the toner particle and maintaining high dot reproducibility even when stored over a long period of time.

Another object is to provide a liquid developer which is capable of suppressing, even when carbon black is used as a pigment, a decline in image density, image density non-uniformity, and faulty cleaning due to release of carbon black and a manufacturing method of the liquid developer.

The present invention provides a liquid developer comprising a toner particle containing a binder resin and a carbon black, a toner particle dispersing agent, and a carrier liquid, wherein amounts of group 15 elements, group 16 elements, and group 17 elements on a surface of the carbon black are respectively 0.1 atomic percent or less with respect to a total amount of elements on the carbon black surface.

In addition, the present invention provides a manufacturing method of a liquid developer comprising a toner particle containing a carbon black and a binder resin, and a toner particle dispersing agent, wherein amounts of group 15 elements, group 16 elements, and group 17 elements on a surface of the carbon black are respectively 0.1 atomic percent or less with respect to a total amount of elements on the carbon black surface, an acid value of the binder resin is at least 5 mg KOH/g and not more than 50 mg KOH/g, the toner particle dispersing agent is a basic dispersing agent, the manufacturing method comprises a step of bringing the binder resin into contact with the toner particle dispersing agent.

Since the liquid developer according to the present invention is capable of suppressing aggregation among toner particles even when stored over a long period of time, high dot reproducibility can be maintained. In addition, the liquid developer obtained by the manufacturing method according to the present invention is capable of suppressing, even when carbon black is used as a pigment, a decline in image density, image density non-uniformity, and faulty cleaning due to release of the carbon black.

Further features of the present invention will become apparent from the following description of exemplary embodiments (with reference to the attached drawings).

BRIEF DESCRIPTION OF THE DRAWINGS

The drawing is an example of an image forming apparatus.

DESCRIPTION OF THE EMBODIMENTS

Hereinafter, the present invention will be described in detail.

In the present invention, unless otherwise noted, descriptions of "at least  and not more than " or " to " representing a numerical value range are to signify the numerical value range including a lower limit end point and an upper limit end point.

A liquid developer according to the present invention is a liquid developer comprising a toner particle containing a binder resin and a carbon black, a toner particle dispersing agent, and a carrier liquid, wherein amounts of group 15 elements, group 16 elements, and group 17 elements on a surface of the carbon black are respectively 0.1 atomic percent or less with respect to a total amount of elements on the carbon black surface.

In order to suppress aggregation of a toner particle in a liquid developer, it is important to control interactions between toner particles in the liquid in addition to using a toner particle dispersing agent. In particular, when using carbon black as a black pigment, an effect of the carbon black present in a vicinity of a surface of the toner particle on the aggregation of the toner particle cannot be ignored. This is because interactions of various functional groups on a surface of the carbon black make the toner particle readily aggregable in the liquid.

While there are several interactions that cause aggregation of the toner particle in the liquid, one characteristic that must be controlled among such interactions is polarity. Polarity refers to an electrical bias which is created when centers of gravity of a positive charge and a negative change in a molecule do not coincide with each other. Generally, in a liquid, since stability increases when molecules with polarity aggregate, aggregation occurs more readily when a large number of molecules with polarity are present on the surface of the toner particle. In other words, even with carbon black present in the vicinity of the surface of the toner particle, the presence of molecules with polarity on the surface of the carbon black may possibly promote the aggregation of the toner particle.

One of the factors which give a molecule polarity is a difference in electronegativity between atoms of different types constituting the molecule. Electronegativity is a measure of intensity of a force by which an atom inside a molecule attracts an electron. When there is an atom with high electronegativity in the molecule, an electrical bias readily occurs in the molecule to impart a high polarity to the molecule. Generally, atoms on a right side of the periodic table have higher electronegativity than those on a left side, and electronegativity further increases going up the periodic table. In other words, group 15 elements, group 16 elements, and group 17 elements have high electronegativity and, among these elements, nitrogen, oxygen, fluorine, chlorine, and sulfur have particularly high electronegativity.

The present inventors conducted intensive studies in consideration of the need to not only use a toner particle dispersing agent but to also focus on elements contained in functional groups present on the surface of carbon black in order to suppress aggregation of a toner particle in a liquid developer. As a result, it was found that an aggregation force between toner particles further increases when using, as a pigment, carbon black having a surface on which functional groups including group 15 elements, group 16 elements, and group 17 elements with high electronegativity are present.

This is conceivably due to the fact that carbon black present in a vicinity of the surface of the toner particle makes the toner particle readily aggregable due to polarity of the functional groups on the carbon black surface. Studies carried out by the present inventors revealed that long-term storage of a liquid developer fabricated using such carbon black increases the possibility of aggregation of a toner particle in the liquid developer and causes dot reproducibility to decline.

In addition, a manufacturing method of a liquid developer according to the present invention is a manufacturing method of a liquid developer including a toner particle containing carbon black and a binder resin, and a toner particle dispersing agent, wherein amounts of group 15 elements, group 16 elements, and group 17 elements on a surface of the carbon black are respectively 0.1 atomic percent or less with respect to a total amount of elements on the carbon black surface, an acid value of the binder resin is at least 5 mg KOH/g and not more than 50 mg KOH/g, the toner particle dispersing agent is a basic dispersing agent, and the binder resin and the toner particle dispersing agent are brought into contact with each other.

There are demands to make a toner particle finer than before in order to meet recent needs for higher image quality. However, there is a problem that, generally, the finer the particles dispersed in a liquid, the more likely aggregation occurs between the particles. In consideration thereof, designing a binder resin used in a toner particle and a toner particle dispersing agent with appropriate materials is important for obtaining a liquid developer with a fine particle size and preferable dispersibility.

To this end, the present inventors considered it necessary to impart an appropriate acid value to the binder resin and use a basic dispersing agent as the toner particle dispersing agent in order to cause the toner particle dispersing agent and the binder resin to react in an efficient manner and to maximize a dispersion effect of the toner particle dispersing agent. Studies carried out by the present inventors revealed that when the acid value of the binder resin is at least 5 mg KOH/g and not more than 50 mg KOH/g and the toner particle dispersing agent is basic, the toner particle dispersing agent reacts efficiently with the binder resin and the dispersion effect of the toner particle dispersing agent can be maximized.

Furthermore, the present inventors found that, in order to have the present invention produce its objective effect, it is important to regulate an abundance ratio of elements on a surface of carbon black in addition to satisfying the conditions described above. Specifically, respectively setting amounts of group 15 elements, group 16 elements, and group 17 elements on the surface of the carbon black to 0.1 atomic percent or less with respect to a total amount of elements on the carbon black surface is also an essential condition for achieving the object of the present invention.

Hereinafter, the reasons therefor will be described.

Generally, carbon black has various functional groups on its surface. When carbon black has a reactive functional group on its surface, a toner particle dispersing agent originally intended to react with a binder resin ends up reacting first with the functional group on the carbon black surface. As a result, in addition to impairing dispersibility of a toner particle, the carbon black which binds with the toner particle dispersing agent is dispersed instead of being encapsulated in the binder resin and is released outside of the toner particle.

In this case, a reactive functional group refers to a functional group including an element with high electronegativity inside a molecule. Generally, atoms on a right side of the periodic table have higher electronegativity than those on a left side, and electronegativity further increases going up the periodic table. In other words, group 15 elements, group 16 elements, and group 17 elements have high electronegativity and, among these elements, nitrogen, oxygen, fluorine, chlorine, and sulfur have particularly high electronegativity and are highly reactive.

The present inventors conducted intensive studies in consideration of the need to control the acid value of the binder resin to a desired value and to further focus on elements included in functional groups present on the surface of carbon black in order to cause the toner particle dispersing agent and the binder resin to react with each other in an efficient manner. As a result, it was found that the toner particle dispersing agent tends to react more readily with carbon black than the binder resin when using, as a pigment, carbon black having a surface on which functional groups including group 15 elements, group 16 elements, and group 17 elements with high electronegativity are present. It was also found that carbon black released after reacting with the toner particle dispersing agent acts as a leakage site of charges and is likely to cause a decline in image density and that fine carbon black released outside of the toner particle may become a major factor in occurrences of faulty cleaning.

Hereinafter, materials constituting the liquid developer according to the present invention will be described in detail.

<Carbon Black>

In carbon black used in the present invention, amounts of group 15 elements, group 16 elements, and group 17 elements on a surface of the carbon black are respectively 0.1 atomic percent or less with respect to a total amount of elements on the carbon black surface. In particular, amounts of atoms of nitrogen, oxygen, fluorine, chlorine, and sulfur among such elements are favorably 0.1 atomic percent or less.

When the amounts of group 15 elements, group 16 elements, and group 17 elements on the surface of the carbon black are respectively 0.1 atomic percent or less with respect to the total amount of elements on the carbon black surface, since aggregation of the toner particle in the liquid developer can be suppressed, high dot reproducibility can be obtained even when using a liquid developer stored for a long period of time. In addition, release of carbon black due to a reaction between the carbon black and a toner particle dispersing agent can be suppressed. As a result, a decline in image density caused by the carbon black released to the outside of the toner particle acting as a leakage site can be suppressed. The smaller the amounts of group 15 elements, group 16 elements, and group 17 elements on the carbon black surface, the more favorable.

The amounts of group 15 elements, group 16 elements, and group 17 elements on the carbon black surface can be controlled by a temperature of a heat treatment or a degree of chemical treatment of the surface to be described later.

As the carbon black used in the present invention, for example, surface-modified carbon black obtained by performing a heat treatment and a chemical treatment of the surface can be used. In particular, a graphitized carbon black obtained by performing a heat treatment of the surface is favorable due to improved antioxidation stability of the surface and a smaller amount of residual functional groups.

Examples of carbon black which may be used as a raw material of the graphitized carbon black include carbon black, lamp black, thermal black, channel black, and other various byproduct carbon blacks manufactured by a conventionally-known furnace method, channel method, and thermal method.

In addition, the carbon black used in the present invention is favorably graphitized carbon black with a lattice spacing of a graphite (002) plane as measured by X-ray diffraction of at least 0.3370 nm and not more than 0.3450 nm. The lattice spacing of the (002) plane of graphite with a perfect graphite structure in which hexagonal network planes of carbon atoms are regularly stacked is known to be 0.3354 nm. In addition, the lattice spacing of a carbon precursor with a less developed crystalline structure than graphite is known to be at least 0.3470 nm and not more than 0.3600 nm.

In other words, a value of the lattice spacing of the graphite (002) plane is a parameter indicating a degree of development of graphite crystallization. Graphitized carbon black with a graphitized surface has a smaller number of functional groups on its surface and, in particular, capable of preventing functional groups with polarity from binding due to changes over time such as oxidation.

Although the smaller the lattice spacing, the further the process of graphitization (crystallization), since carbon black generally has poor crystallizability, it is difficult to set the lattice spacing to less than 0.3370 nm. On the other hand, since a lattice spacing of not more than 0.3450 nm produces carbon black with a sufficiently graphitized (crystallized) surface, functional groups with polarity on the surface can be reduced. As a result, since aggregation of the toner particle in the liquid developer can be suppressed, high dot reproducibility can be obtained even when using a liquid developer stored for a long period of time. In addition, since release of carbon black due to a reaction between the carbon black and the toner dispersing agent can be suppressed, a decline in image density caused by the carbon black released to the outside of the toner particle acting as a leakage site can be suppressed.

The graphitized carbon black described above can be obtained by filling a graphite crucible with ordinary carbon black and calcining the graphite crucible in a non-oxidizing atmosphere at a temperature of at least 1000° C. and not more than 3200° C.

<Binder Resin>

As the binder resin usable in the present invention, known binder resins having fixability to an adherend such as paper and plastic films can be used as long as the binder resins are insoluble in a carrier liquid. In this case, an indicator of being "insoluble in a carrier liquid" is that not more than 1 part by mass of the binder resin is soluble in 100 parts by mass of the carrier liquid.

Examples of such a binder resin include polyester resin, epoxy resin, ester resin, vinyl resin (for example, (meth) acrylic resin and styrene-(meth) acrylic resin), alkyd resin, polyethylene resin, ethylene-(meth) acrylic resin, and rosin-modified resin. In addition, when necessary, these binder resins may be used independently or two or more binder resins may be used in combination.

Moreover, the content of the carbon black is favorably at least 1 part by mass and not more than 100 parts by mass relative to 100 parts by mass of the binder resin.

<Toner Particle Dispersing Agent>

The toner particle dispersing agent usable in the present invention causes a toner particle to disperse in a carrier liquid in a stable manner and is not limited to a specific type as long as the toner particle dispersing agent is used for this purpose. In addition, the toner particle dispersing agent may dissolve in the carrier liquid or disperse in the carrier liquid.

The toner particle dispersing agent is favorably a basic dispersing agent. From the perspective of reactivity with a binder resin, the toner particle dispersing agent is favorably a basic dispersing agent containing an amino group as a base moiety. Since the use of such a toner particle dispersing agent enables the toner particle dispersing agent to uniformly adhere to a surface of the binder resin, a surface composition of a toner particle becomes uniform and, consequently, a toner particle with a uniform charge distribution is more readily obtained. A liquid developer using such a toner particle is capable of obtaining an image with no image density non-uniformity.

Examples of such a dispersing agent include Ajisper PB817 (manufactured by Ajinomoto Fine-Techno Co., Inc.) and Solsperse 11200, 13940, 17000, 18000, and 36000 (manufactured by Lubrizol Japan Limited). In addition, examples of a basic dispersing agent containing an amino group include Ajisper PB817 and Solsperse 13940.

The content of the toner particle dispersing agent is favorably at least 0.5 parts by mass and not more than 30 parts by mass relative to 100 parts by mass of the toner particle. The use of the toner particle dispersing agent in this range further improves dispersibility of the toner particle.

In addition, an acid value of the binder resin used in the liquid developer according to the present invention is favorably at least 5 mg KOH/g and not more than 50 mg KOH/g. Furthermore, the toner particle dispersing agent is favorably a basic dispersing agent. Since the use of a binder resin with an acid value of at least 5 mg KOH/g and a basic dispersing agent as the dispersing agent enables an acidic moiety on the surface of the toner particle and a base moiety included in the dispersing agent to effectively bind with each other, a more favorable state of dispersion of the toner particle in the liquid developer can be realized. As a result, since aggregation of the toner particle in the liquid developer can be suppressed, high dot reproducibility can be obtained even after storing the liquid developer for a long period of time. In addition, since a binder resin with an acid value of at least 5 mg KOH/g enables an acidic moiety of the binder resin and a base moiety of the toner particle dispersing agent to effectively react with each other, a toner particle with a uniform surface composition can be obtained. As a result, the toner particle is charged uniformly and an image with no image density non-uniformity can be obtained.

On the other hand, a binder resin with an acid value of not more than 50 mg KOH/g prevents the amount of functional groups with polarity from increasing excessively on the surface of the toner particle and a more favorable state of dispersion of the toner particle in the liquid developer can be realized. As a result, since aggregation of the toner particle in the liquid developer can be suppressed, high dot reproducibility can be obtained even after storing the liquid developer for a long period of time. Furthermore, an acid value of not more than 50 mg KOH/g prevents charges from becoming unstable due to an excessive increase of the acid value of the toner particle surface. As a result, the toner particle is charged uniformly and an image with no image density non-uniformity can be obtained. The acid value of the binder resin can be controlled by a type of a used monomer.

<Carrier Liquid>

A carrier liquid may be used in the present invention. The used carrier liquid is not particularly limited as long as the carrier liquid has high volume resistivity, provides electrical insulation, and has low viscosity at around room temperature.

Specific examples thereof include hydrocarbon-based solvents such as hexane, heptane, and octane, liquid paraffin-based solvents such as IsoparE,G (manufactured by Maruzen Chemical Trading Co., Ltd.), IsoparG, IsoparE, and IsoparL (manufactured by Exxon Mobil Corporation), and Moresco White P-40 (manufactured by MORESCO Corporation), and silicone compounds.

The volume resistivity of the carrier liquid is favorably at least 1×10 Ω·cm and not more than $1\times10^{15}$ Ω·cm and more favorably at least $1\times10^{10}$ Ω·cm and not more than $1\times10^{15}$ Ω·cm.

(Polymerizable Monomer)

A polymerizable monomer can also be used as the carrier liquid described above, and usable polymerizable monomers are not particularly limited as long as the characteristics of the carrier liquid described above are provided.

Examples of the polymerizable monomer include vinyl ether compounds, epoxy compounds, acrylic compounds, and oxetane compounds.

Among these compounds, vinyl ether compounds are favorable from the perspectives of safety to the human body, high resistance, and low viscosity.

A vinyl ether compound refers to a compound having a vinyl ether structure (—CH═CH—O—C—).

The vinyl ether structure is favorably expressed by R—CH═CH—O—C— (where R denotes hydrogen or an alkyl with a carbon number of 1 to 3 and is favorably hydrogen or methyl).

Examples of the vinyl ether compound include n-octyl vinyl ether, 2-ethylhexyl vinyl ether, dodecyl vinyl ether, octadecyl vinyl ether, benzyl vinyl ether, dicyclopentadiene vinyl ether, cyclohexane dimethanol divinyl ether, tricyclodecane vinyl ether, trimethylolpropane trivinyl ether, 2-ethyl-1,3-hexanediol divinyl ether, 2,4-diethyl-1,5-pentanediol divinyl ether, 2-butyl-2-ethyl-1,3-propanediol divinyl ether, neopentyl glycol divinyl ether, pentaerythritol tetravinyl ether, and 1,2-decanediol divinyl ether.

When using an ultraviolet-curable liquid developer as the liquid developer according to the present invention, a photopolymerization initiator or a photopolymerization sensitizer can be used together with the polymerizable monomer described above. As the photopolymerization initiator and the photopolymerization sensitizer, any known compound can be used as long as the photopolymerization initiator and the photopolymerization sensitizer do not cause the volume resistivity of the liquid developer to decline excessively and the viscosity thereof to increase excessively.

<Pigment Dispersing Agent>

In the present invention, a pigment dispersing agent or a pigment dispersing auxiliary can also be used when dispersing carbon black.

Examples of the pigment dispersing agent include hydroxyl group-containing carboxylic acid ester, a salt of a long-chain polyaminoamide and high-molecular-weight acid ester, a salt of high-molecular-weight polycarboxylic acid, high-molecular-weight unsaturated acid ester, a macromolecular copolymer, polyester and modified products thereof, modified polyacrylate, aliphatic polycarboxylic acid, naphthalene sulfonic acid formalin condensate, polyoxyethylene alkyl phosphate ester, and pigment derivatives.

In addition, synergists in accordance with various pigments can also be used.

The pigment dispersing agents and the pigment dispersing auxiliaries are favorably added in an amount of at least 1 part by mass and not more than 100 parts by mass relative to 100 parts by mass of the pigment.

While a method of adding the pigment dispersing agent is not particularly limited, adding the pigment dispersing agent in a process of dispersing the pigment is favorable from the perspective of pigment dispersibility.

<Charge Adjuvant>

In the present invention, a charge adjuvant can be included for the purpose of adjusting chargeability of a toner particle. Known charge adjuvants can be used.

Examples of specific compounds include: metal soaps such as zirconium naphthenate, cobalt naphthenate, nickel naphthenate, iron naphthenate, zinc naphthenate, cobalt octylate, nickel octylate, zinc octylate, cobalt dodecylate, nickel dodecylate, zinc dodecylate, aluminum stearate, aluminum tristearate, and cobalt 2-ethylhexanoate; sulfonic acid metal salts such as a petroleum-based sulfonic acid metal salt and metal salts of sulfosuccinic acid ester; phospholipids such as lecithin; salicylic acid metal salts such as a t-butyl salicylic acid metal complex; polyvinylpyrrolidone resin, polyamide resin, sulfonic acid-containing resin, and hydroxybenzoic acid derivatives.

<Other Materials>

When necessary, various known additives may be used in the liquid developer according to the present invention for the purpose of improving various performances including compatibility with a recording medium and image storability. For example, a surfactant, a lubricant, a filler, a defoaming agent, an ultraviolet absorber, an antioxidant, a discoloration inhibitor, and a rust inhibitor can be selected and used as deemed appropriate.

<Manufacturing Method>

In the present invention, a manufacturing method of a liquid developer is not particularly limited and examples include known methods such as a coacervation method, a wet pulverization method, and a suspension polymerization method.

The coacervation method is described in detail in, for example, Japanese Patent Application Laid-open No. 2003-241439, WO 2007/000974, and WO 2007/000975.

In the coacervation method, by mixing carbon black, a binder resin, a toner particle dispersing agent, a solvent for dissolving the binder resin, and a solvent which does not dissolve the binder resin, removing the solvent for dissolving the binder resin from the mixed liquid, and depositing the binder resin in the dissolved state, a toner particle encapsulating the carbon black can be dispersed in the solvent which does not dissolve the binder resin.

Meanwhile, the wet pulverization method is described in detail in, for example, WO 2006/126566 and WO 2007/108485.

In the wet pulverization method, by kneading a pigment and a binder resin at a melting point of the binder resin or a higher temperature and then drying and pulverizing the kneaded mixture, and subsequently wet-pulverizing the obtained pulverized article in an electrically-insulating medium, a toner particle can be dispersed in the electrically-insulating medium.

In the present invention, such known methods can be used.

In the manufacturing method of a liquid developer, favorably, the binder resin and the toner particle dispersing agent are brought into contact with each other. The coacervation method is favorably adopted from the perspective of the encapsulation behavior of carbon black.

The coacervation method includes:

a step of preparing a pigment-dispersed solution containing carbon black, a binder resin, a toner particle dispersing agent, and a solvent (a pigment dispersion step);

a step of adding a non-aqueous solution to the pigment-dispersed solution (a mixing step); and a step of distilling out the solvent from the pigment-dispersed solution to which the non-aqueous solution has been added (mixed liquid) (a distillation step).

The solvent is favorably capable of dissolving the binder resin. In addition, the non-aqueous solution favorably does not dissolve the binder resin. A carrier liquid can also be used as the non-aqueous solution. By distilling out the solvent to deposit the binder resin in the dissolved state, a toner particle encapsulating carbon black can be dispersed in the solvent which does not dissolve the binder resin. In this case, an indicator of "not dissolving the binder resin" is that not more than 1 part by mass of the binder resin is dissolved in 100 parts by mass of the solvent or the non-aqueous solution. In the coacervation method, for example, the binder resin and the toner particle dispersing agent can be brought into contact with each other by performing the pigment dispersion step described above.

The suspension polymerization method includes: a step of dispersing a polymerizable monomer composition containing a polymerizable monomer for forming a binder resin, carbon black, and a toner particle dispersing agent in an aqueous medium to form a particle of the polymerizable monomer composition (a granulating step); and polymerizing the polymerizable monomer included in the particle to obtain a toner particle (a polymerization step). In the suspension polymerization method, for example, the binder resin and the toner particle dispersing agent can be brought into contact with each other by performing the polymerization step described above.

<Particle Size of Toner Particle>

From the perspectives of obtaining high dot reproducibility and reducing image density non-uniformity, the toner particle used in the present invention favorably has a volume median diameter D50 of at least 0.5 μm and not more than 1.5 μm. When the volume median diameter D50 of the toner particle is at least 0.5 μm, since the toner particle is less likely to aggregate in a liquid developer, a liquid developer with superior dot reproducibility and a reduced tendency of occurrences of image density non-uniformity can be obtained. In addition, when the volume median diameter D50 of the toner particle is not more than 1.5 μm, since images can be formed with a fine toner particle which is a feature of a liquid developing method, a liquid developer with superior dot reproducibility and a reduced tendency of occurrences of image density non-uniformity can be obtained.

Furthermore, a volume-equivalent 5% cumulative mean diameter D5 of the toner particle is favorably at least 0.2 μm from the perspective of faulty cleaning. When D5 of the toner particle in the liquid developer is at least 0.2 μm, a liquid developer with preferable cleaning performance can be obtained.

In the present invention, while a toner particle concentration in the liquid developer can be arbitrarily adjusted in accordance with an image forming apparatus used, the toner particle concentration is favorably at least 1 mass % and not more than 70 mass %.

Next, methods of measuring physical properties related to the present invention will be described below.

(1) Element Content on Carbon Black Surface

As a measurement of the element content on the carbon black surface, a surface composition analysis was performed using X-ray photoelectron spectroscopy (apparatus name: PHI 5000 VersaProbe II, manufactured by ULVAC-PHI, Inc.) to calculate the element content.

Primary conditions were as listed below.

Output: 100μ 25 W 15 kV

Measurement range: 300 μm×300 μm

Pass Energy: 23.5 eV

Step Size: 0.1 eV

In the present invention, a surface atomic concentration of carbon black was calculated using a relative sensitivity factor provided by ULVAC-PHI, Inc. from a measured peak intensity of each element.

Moreover, carbon black in toner can be extracted by first performing a dispersion process of the toner in toluene to dissolve a binder resin, separating the carbon black using a filter paper, and subjecting the carbon black to cleaning and drying processes. The element content described above can be measured using the extracted carbon black.

(2) Acid Value of Binder Resin

The acid value of the binder resin was measured based on JIS K 0070-1992. Details were as follows.

1) Exactly weigh 0.5 to 2.0 g of a specimen. Let mass at this point be denoted by M (g).

2) Place the specimen in a 50 ml beaker and add 25 ml of a mixed liquid of tetrahydrofuran/ethanol (2/1) to dissolve the specimen.

3) Using an ethanol solution with 0.1 mol/l KOH, perform titration with a potentiometric titration measurement apparatus (for example, automatic titrator "COM-2500" manufactured by Hiranuma Sangyo Co., Ltd. can be used).

4) Let the amount of the KOH solution used at this point be denoted by S (ml). At the same time, measure a blank and let the amount of the KOH used be denoted by B (ml).

5) Calculate the acid value according to the following equation, where f denotes a factor of the KOH solution.

$$\text{Acid value [mg KOH/g]}=(S-B)\times f\times 5.61/M$$

(3) Volume Median Diameter D50 and Volume-Equivalent 5% Cumulative Mean Diameter D5 of Toner Particle 0.05 ml of the liquid developer was diluted in 4 ml of dodecyl vinyl ether (DDVE) and stirred with a shaking device, and subsequently measured three times in a corresponding carrier liquid using a dynamic light scattering method (DLS) particle size distribution measuring apparatus (trade name: Nanotrac 150, manufactured by Nikkiso Co., Ltd.), whereby an average value was adopted.

(4) Lattice Spacing of Graphite (002) Plane by X-Ray Diffraction of Carbon Black With carbon black powder as a measurement specimen, lattice spacing was obtained from an X-ray diffraction spectrum using a sample-horizontal type strong X-ray diffractometer (trade name: "RINT/TTR-II", manufactured by Rigaku Corporation). First, a non-reflective specimen plate was filled with the measurement specimen and an X-ray diffraction chart was obtained using a CuK α ray monochromatized by a monochromator as a ray source. Accordingly, a peak position of a graphite (002) diffraction line was obtained and the lattice spacing was calculated according to Bragg's equation (expression (1) below). The CuK α ray had a wavelength λ of 0.15418 nm.

$$\text{Lattice spacing (002)}=\lambda/2\sin\theta \quad (1)$$

Primary measurement conditions were as follows.

Optical system: parallel beam optical system, goniometer: horizontal rotor goniometer (TTR-2), tube voltage/current: 50 kV/300 mA, measurement method: continuous method, scan axis: 2θ/θ, measurement angle: 10° to 50°, sampling interval: 0.02°, scan rate: 4°/min, divergence slit: open, divergence longitudinal slit: 10 mm, scattering slit: open, and light receiving slit: 1.00 mm.

(Measurement Using Toner)

Carbon black in toner can be extracted by first performing a dispersion process of the toner in toluene to dissolve a binder resin, separating the carbon black using a filter paper, and subjecting the separated carbon black to cleaning and drying processes. The lattice spacing described above can be measured using the extracted carbon black.

(5) pH of Toner Particle Dispersing Agent 0.5 g of the toner particle dispersing agent and 20 ml of distilled water were placed in a glass screw tube and, after shaking the screw tube for 30 minutes using a paint shaker, pH of a filtrate obtained by filtering the mixture was measured using a pH meter (trade name: "D-51", manufactured by Horiba, Ltd.). Moreover, as a result, dispersing agents with a measured pH higher than 7 were considered basic dispersing agents.

(6) Molecular Weight of Binder Resin

A polystyrene-equivalent molecular weight of the binder resin was calculated by gel permeation chromatography (GPC). The molecular weight measurement by GPC was performed as follows.

A solution obtained by adding a sample to an eluent described below to attain a sample concentration of 1.0 mass % and allowing the mixture to stand at room temperature for 24 hours to dissolve the sample was filtered using a solvent-resistant membrane filter with a pore size of 0.20 μm to obtain a sample solution, which was then measured under the following conditions.

Apparatus: high-speed GPC apparatus "HLC-8220GPC" (manufactured by Tosoh Corporation)
Column: series of two LF-804
Eluent: tetrahydrofuran (THF)
Flow rate: 1.0 mL/min
Oven temperature: 40° C.
Injected specimen amount: 0.025 mL Molecular weights of specimens were calculated using molecular weight calibration curves created with standard polystyrene resins (TSK standard polystyrene F-850, F-450, F-288, F-128, F-80, F-40, F-20, F-10, F-4, F-2, F-1, A-5000, A-2500, A-1000, and A-500 manufactured by Tosoh Corporation).

EXAMPLES

While basic configurations and features of the present invention have been described above, the present invention will now be described in more concrete terms based on examples. However, it is to be understood that the present invention is by no means limited to these examples. Moreover, parts and % used in the Examples are on a mass basis unless otherwise specifically noted.

<Carbon Black 1>

Carbon black (trade name: Tokablack #5500, manufactured by Tokai Carbon Co., Ltd.) was placed in a graphite crucible and graphitized by a heat treatment performed in a nitrogen gas atmosphere at 2500° C. to obtain carbon black 1. Values of physical properties of the obtained carbon black were as shown in Table 1.

<Carbon Blacks 2 to 7>

The heat treatment temperature was altered as shown in Table 1 from the example of manufacturing carbon black 1 to manufacture carbon blacks 2 to 7 having different surface element concentrations and degrees of graphitization. The graphitization process was performed by filling carbon black in a graphite crucible and subjecting the graphite crucible to a heat treatment in a nitrogen gas atmosphere at a temperature of at least 1500° C. and not more than 3000° C. Values of physical properties of the obtained carbon blacks were as shown in Table 1.

<Carbon Black 8>

MA77 (manufactured by Mitsubishi Chemical Corporation) was used as carbon black 8. Values of physical properties of carbon black 8 were as shown in Table 1.

<Carbon Black 9>

Monarch 280 (manufactured by Cabot Corporation) was used as carbon black 9. Values of physical properties of carbon black 9 were as shown in Table 1.

<Carbon Black 10>

25 parts by mass of carbon black (trade name: Unipure Black LC902, manufactured by Sensient Cosmetic Technologies) were mixed with 30 parts by mass of N,N'-dimethylformamide and stirred while introducing nitrogen. After adding 5 parts by mass of thionyl chloride, the mixture was irradiated with ultrasound waves and reaction was performed for 1 hour. Next, 15 parts by mass of sulfanilic acid were added, the temperature was raised to 65° C., and stirring was continued for 1 hour. Subsequently, an aqueous sodium hydroxide solution was added after cooling the mixture to room temperature, the mixture was subjected to pressure filtration using a 0.1 μm membrane filter to separate solids and then cleaned with a small amount of desalinated water and dried under reduced pressure at 100° C. to obtain carbon black 10. A measurement of surface elements of the obtained carbon black 10 resulted in detected peaks derived from nitrogen and oxygen. Physical properties of carbon black 10 were as shown in Table 1.

<Carbon Black 11>

200 parts by mass (effective chlorine concentration of 20% relative to carbon) of sodium hypochlorite (Antiformin manufactured by Yoneyama Yakuhin Kogyo Co., Ltd., effective chlorine concentration of approximately 10%) were weighed relative to 100 parts by mass of carbon black (trade name: MA77, manufactured by Mitsubishi Chemical Corporation), and the mixture was diluted by purified water in an amount 4 times that of the mixture (0.2% aqueous solution of sodium hypochlorite) and placed in a beaker. Subsequently, the mixture was stirred in room temperature for 3 hours and, after ending reaction, filtered and washed with water. Warm water in an amount 10 times that of the carbon black was used for the water washing, and the water washing and filtration were repeated at least twice. Subsequently, the mixture was dried at 130° C. for 24 hours to obtain carbon black 11. A measurement of surface elements of the obtained carbon black 11 resulted in a detected peak derived from chlorine. Physical properties of carbon black 11 were as shown in Table 1.

<Binder Resin 1>

| | |
|---|---|
| Bisphenol A ethylene oxide (2.5 mol) adduct (BPA-EO) | 40 parts by mass |
| Terephthalic acid (TFA) | 40 parts by mass |
| Tetra-butyl titanate (TNBT) | 0.2 parts by mass |

The materials listed above were prepared and reacted for 10 hours while distilling out produced water in a nitrogen gas stream at 220° C. Next, after reaction under reduced pressure of at least 5 mmHg and not more than 20 mmHg, the mixture was cooled to 180° C. and 20 parts by mass of trimellitic anhydride (TMA) were added thereto, sealed under normal pressure and extracted after reaction for 2 hours, then cooled to room temperature and subsequently pulverized to obtain polyester resin. The obtained polyester resin was dissolved in THF to attain 50% by mass of the polyester resin to obtain a binder resin 1 with a weight-average molecular weight of Mw 11,000 and an acid value of 20 mg KOH/g.

<Binder Resins 2 to 5>

With the exception of altering a raw material ratio as shown in Table 2, binder resins 2 to 5 were obtained in a similar manner to binder resin 1. Various physical properties of the obtained binder resins were as shown in Table 2.

<Binder Resin 6>

| | |
|---|---|
| Styrene | 70 parts by mass |
| n-butyl acrylate | 24 parts by mass |
| Monobutyl maleate | 6 parts by mass |
| Di-t-butyl peroxide | 1 part by mass |

The materials listed above were delivered by drops into 200 parts by mass of xylene over 4 hours. In addition, polymerization was completed under reflux of xylene. Subsequently, the temperature was raised to distill out an organic solvent, and the mixture was cooled to room temperature and then pulverized to obtain binder resin 6 with a weight-average molecular weight of Mw 10,500 and an acid value of 20 mg KOH/g.

<Toner Particle Dispersing Agents 1 to 4>

Toner particle dispersing agents 1 to 4 used in the present practical example and comparative examples are shown in Table 3.

<Synthesis of Pigment Dispersing Agent>

100 parts of a toluene solution (with a solid content of 50%) of a polycarbodiimide compound having an isocyanate group and having a carbodiimide equivalent of 262 and 8.5 parts of N-methyl diethanolamine were prepared and held for 3 hours at approximately 100° C. to cause the isocyanate group to react with a hydroxyl group. Next, 39.6 parts of an ε-caprolactone self-polycondensate having a carboxyl group at its terminal and having a number-average molecular weight of 8500 were prepared and, after being held for 2 hours at approximately 80° C. to cause a carbodiimide group to react with the carboxyl group, toluene was distilled out under reduced pressure to obtain a pigment dispersing agent (with a solid content of 100%) with a number-average molecular weight of approximately 13000.

<Liquid Developer 1>

| | |
|---|---|
| Carbon black 1: | 10 parts by mass |
| Pigment dispersing agent: | 10 parts by mass |
| Tetrahydrofuran (THF): | 80 parts by mass |

were mixed, the mixture was stirred for 1 hour with a paint shaker using glass beads with a diameter of 2 mm to obtain a pigment-dispersed slurry 1,

| | |
|---|---|
| Pigment-dispersed slurry 1: | 60 parts by mass |
| Binder resin 1: | 80 parts by mass |
| Toner particle dispersing agent 1: | 12 parts by mass |

(Ajisper PB-817, basic, manufactured by Ajinomoto Fine- Techno Co., Inc.)

were subsequently mixed by a high-speed disperser (T. K. Robomics with T. K. Homogenizing Disper Model 2.5 blade, manufactured by PRIMIX Corporation) by stirring at 40° C. to obtain a pigment-dispersed solution 1.

200 parts by mass of dodecyl vinyl ether (DDVE) were gradually added to the pigment-dispersed solution 1 (100 parts by mass) obtained above while stirring at high speed (number of revolutions: 15000 rpm) using a homogenizer (Ultra-Turrax T50, manufactured by IKA Works, Inc.) to obtain a mixed liquid 1.

The obtained mixed liquid 1 was transferred to a recovery flask and subjected to ultrasonic dispersion at 50° C. to completely distill out THF to obtain a toner particle dispersion 1 in which a toner particle is contained in a curable insulating liquid.

The obtained toner particle dispersion 1 (10 parts by mass) was subjected to a centrifugal separation process, a supernatant was removed by decantation and replaced with new DDVE with a same mass as the removed supernatant, and the toner particle dispersion 1 was then redispersed.

Subsequently, 0.10 parts by mass of hydrogenated lecithin (trade name: Lecinol S-10, manufactured by Nikko Chemicals Co., Ltd.), 90 parts by mass of DDVE, photopolymerization initiators (0.30 parts by mass of trade name "NHNI-PFBS" manufactured by Toyo Gosei Co., Ltd.), and 1 part by mass of trade name "KAYACURE-DETX-S" (manufactured by Nippon Kayaku Co., Ltd.) were added to obtain a liquid developer 1.

The toner particle contained in the obtained toner particle dispersion had a volume median diameter D50 of 0.7 μm.

<Liquid Developers 2 to 10 and 13 to 16>

With the exception of altering carbon black, a binder resin, a toner particle dispersing agent, and a carrier liquid as shown in Table 4, liquid developers 2 to 9 and 13 to 16 were obtained in a similar manner to the liquid developer 1. In addition, a liquid developer 10 was obtained in a similar manner to the liquid developer 9 with the exception of changing the number of revolutions of the homogenizer to 24,000 rpm. Physical properties were as shown in Table 4.

<Liquid Developer 11>

| | |
|---|---|
| Carbon black 7: | 10 parts by mass |
| Binder resin 5: | 70 parts by mass |
| Pigment dispersing agent: | 10 parts by mass |

The materials listed above were first thoroughly mixed by a Henschel mixer and then subjected to melt-kneading using a co-rotating twin-screw extruder at a roll internal heating temperature of 100° C., the obtained mixture was cooled and then coarsely pulverized, and wet classification was performed to obtain a classified toner particle. Next, 80 parts by mass of dodecyl vinyl ether (DDVE), 20 parts by mass of the classified toner particle obtained above, and 4.5 parts by mass of a toner particle dispersing agent (Ajisper PB-817, manufactured by Ajinomoto Fine-Techno Co., Inc.) were mixed for 24 hours using a sand mill to obtain a toner particle dispersion 11. The obtained toner particle dispersion 11 (10 parts by mass) was subjected to a centrifugal separation process, a supernatant was removed by decantation and replaced with new DDVE with a same mass as the removed supernatant, and the toner particle dispersion 11 was then redispersed.

Subsequently, 0.10 parts by mass of hydrogenated lecithin (trade name: Lecinol S-10, manufactured by Nikko Chemicals Co., Ltd.), 90 parts by mass of DDVE, photopolymerization initiators (0.30 parts by mass of trade name "NHNI-PFBS" manufactured by Toyo Gosei Co., Ltd.), and 1 part by mass of trade name "KAYACURE-DETX-S" (manufactured by Nippon Kayaku Co., Ltd.) were added to obtain a liquid developer 11. A composition and various physical properties of the liquid developer 11 were as shown in Table 4.

<Liquid Developer 12>

A liquid developer 12 was obtained in a similar manner to the liquid developer 11 with the exception of replacing DDVE with IsoparE,G (manufactured by Maruzen Chemical Trading Co., Ltd.). A composition and various physical properties of the liquid developer 12 were as shown in Table 4.

Example 1

The liquid developer 1 was allowed to stand in a 40° C. environment for 3 months, and liquid developers before and after the standing period were used to perform the following assessment.

<Assessment of Image Quality of Dot Image>

An electrostatic pattern was formed on a sheet of electrostatic recording paper with a surface charge of 500 V, a dot image (FFH image) in which 1 pixel is formed by 1 dot (at least 20,000 $\mu m^2$ and not more than 25,000 $\mu m^2$) was created using the liquid developer 1, and development was performed at a process speed of 20 mm/sec using a roller developer with a metal roller. Moreover, a distance (developing gap) between the roller and the sheet of electrostatic recording paper was set to 34 μm. An area corresponding to 1000 dots was measured using a digital microscope VHX-500 (lens: Wide-range Zoom Lens VH-Z100, manufactured by Keyence Corporation). A number average (S) of the dot area and a standard deviation (σ) of the dot area were calculated, and a graininess index was calculated according to the following equation.

$$\text{Graininess index } (I) = \sigma / S \times 100$$

(Assessment Criteria)

A (very favorable): I is less than 1.0

B (favorable): I is at least 1.0 and less than 2.0

C (practical level): I is at least 2.0 and less than 4.0

D (graininess is noticeable): I is at least 4.0

Moreover, an FFH image expresses values of 256 shades of gray represented in hexadecimal, where OOH represents a 1st shade of gray (white) and FFH represents a 256th shade of gray (black).

A test result of Example 1 is shown in Table 5.

Examples 2 to 12

Examples 2 to 12 were assessed in a similar manner to the Example 1 with the exception of altering the liquid developer as shown in Table 5. Assessment results were as shown in Table 5.

Comparative Examples 1 to 4

Comparative examples 1 to 4 were assessed in a similar manner to the Example 1 with the exception of altering the liquid developer as shown in Table 5. Assessment results were as shown in Table 5.

The results shown in Table 5 reveal that favorable dot reproducibility is obtained even after long-term storage in the Examples according to the present invention in comparison with the comparative examples 1 to 4 which represent conventional art.

TABLE 1

| Carbon black No. | Heat treatment temperature/ ° C. | Element content on surface/% Group 15 | Group 16 | Group 17 | Lattice spacing of graphite (002) plane/ nm |
|---|---|---|---|---|---|
| 1 | 2500 | 0.0 | 0.0 | 0.0 | 0.3400 |
| 2 | 3000 | 0.0 | 0.0 | 0.0 | 0.3370 |
| 3 | 2200 | 0.0 | 0.0 | 0.0 | 0.3450 |
| 4 | 2000 | 0.0 | 0.0 | 0.0 | 0.3500 |
| 5 | 1500 | 0.0 | 0.0 | 0.1 | 0.3550 |
| 6 | 1500 | 0.0 | 0.1 | 0.1 | 0.3550 |
| 7 | 1500 | 0.1 | 0.1 | 0.1 | 0.3550 |
| 8 | — | 0.0 | 3.5 | 0.0 | 0.3600 |
| 9 | — | 0.0 | 2.0 | 0.0 | 0.3600 |
| 10 | — | 2.0 | 1.5 | 0.0 | 0.3600 |
| 11 | — | 0.0 | 1.3 | 3.0 | 0.3600 |

TABLE 2

| Binder resin No. | BPA-EO/ parts | TFA/ parts | TMA/ parts | TNBT/ parts | Weight-average molecular weight Mw | Acid value (mgKOH/g) |
|---|---|---|---|---|---|---|
| 1 | 40 | 40 | 20 | 0.2 | 11000 | 20 |
| 2 | 50 | 30 | 20 | 0.2 | 15000 | 5 |
| 3 | 30 | 30 | 40 | 0.2 | 10000 | 50 |
| 4 | 60 | 35 | 5 | 0.2 | 9000 | 1 |
| 5 | 30 | 25 | 45 | 0.2 | 8000 | 60 |

TABLE 3

| Toner particle dispersing agent No. | Trade name | Manufacturer | Acid-base |
|---|---|---|---|
| 1 | Ajisper PB817 | Ajinomoto Fine-Techno Co., Inc. | Basic |
| 2 | Solsperse 13940 | Lubrizol Japan Limited | Basic |
| 3 | Solsperse 36000 | Lubrizol Japan Limited | Acidic |
| 4 | KF-2001 | Shin-Etsu Chemical Co., Ltd. | Basic |

TABLE 4

| Liquid developer No. | Material type: Binder resin No. | Toner particle dispersing agent No. | Carbon black No. | Carrier | Toner particle size D50/μm |
|---|---|---|---|---|---|
| 1 | 1 | 1 | 1 | DDVE | 0.7 |
| 2 | 1 | 1 | 2 | Trimethylolpropane trivinyl ether | 0.7 |
| 3 | 6 | 1 | 3 | DDVE | 0.7 |
| 4 | 2 | 1 | 4 | DDVE | 0.7 |
| 5 | 3 | 2 | 4 | DDVE | 0.7 |
| 6 | 4 | 2 | 5 | DDVE | 0.7 |
| 7 | 4 | 2 | 6 | DDVE | 1.5 |
| 8 | 5 | 2 | 7 | DDVE | 1.5 |
| 9 | 5 | 3 | 7 | DDVE | 0.5 |
| 10 | 5 | 3 | 7 | DDVE | 0.3 |
| 11 | 5 | 3 | 7 | DDVE | 0.3 |
| 12 | 5 | 3 | 7 | IsoparE,G | 1.8 |
| 13 | 1 | 4 | 8 | DDVE | 0.7 |
| 14 | 1 | 1 | 9 | DDVE | 0.7 |
| 15 | 1 | 1 | 10 | DDVE | 0.7 |
| 16 | 1 | 1 | 11 | DDVE | 0.7 |

TABLE 5

| | Liquid developer No. | Result of dot reproducibility assessment: Initial | After standing |
|---|---|---|---|
| Example No. | | | |
| 1 | 1 | A | A |
| 2 | 2 | A | A |
| 3 | 3 | A | A |
| 4 | 4 | A | B |
| 5 | 5 | A | B |
| 6 | 6 | B | B |
| 7 | 7 | B | B |
| 8 | 8 | B | B |
| 9 | 9 | B | C |
| 10 | 10 | C | C |
| 11 | 11 | C | C |
| 12 | 12 | C | C |
| Comparative example No. | | | |
| 1 | 13 | A | D |
| 2 | 14 | A | D |
| 3 | 15 | A | D |
| 4 | 16 | A | D |

Next, examples related to the manufacturing method according to the present invention will be described.

<Carbon Black 1B>

Carbon black (trade name: Tokablack #5500, manufactured by Tokai Carbon Co., Ltd.) was placed in a graphite crucible and graphitized by a heat treatment performed in a nitrogen gas atmosphere at 2500° C. to obtain carbon black 1B. Values of physical properties of the obtained carbon black were as shown in Table 6.

<Carbon Blacks 2B to 6B>

The heat treatment temperature was altered from the example of manufacturing carbon black 1B to manufacture carbon blacks 2B to 6B having different surface element concentrations and degrees of graphitization. The graphitization process was performed by filling carbon black in a graphite crucible and subjecting the graphite crucible to a heat treatment in a nitrogen gas atmosphere at a temperature of at least 1500° C. and not more than 3000° C. Values of physical properties of the obtained carbon blacks were as shown in Table 6.

<Carbon Black 7B>

MA77 (manufactured by Mitsubishi Chemical Corporation) was used as carbon black 7B. Values of physical properties of carbon black 7B were as shown in Table 6.

<Carbon Black 8B>

Monarch 280 (manufactured by Cabot Corporation) was used as carbon black 8B. Values of physical properties of carbon black 8B were as shown in Table 6.

<Carbon Black 9B>

25 parts by mass of carbon black (trade name: Unipure Black LC902, manufactured by Sensient Cosmetic Technologies) were mixed with 30 parts by mass of N,N'-dimethylformamide and stirred while introducing nitrogen. After adding 5 parts by mass of thionyl chloride, the mixture was irradiated with ultrasound waves and reaction was performed for 1 hour. Next, 15 parts by mass of sulfanilic acid were added, the temperature was raised to 65° C., and stirring was continued for 1 hour. Subsequently, an aqueous sodium hydroxide solution was added after cooling the mixture to room temperature, the mixture was subjected to pressure filtration using a 0.1 μm membrane filter to separate solids and then cleaned with a small amount of desalinated water and dried under reduced pressure at 100° C. to obtain carbon black 9B. A measurement of surface elements of the obtained carbon black 9B resulted in detected peaks derived from nitrogen and oxygen. Physical properties of carbon black 9B were as shown in Table 6.

<Carbon Black 10B>

200 parts by mass (effective chlorine concentration of 20% relative to carbon) of sodium hypochlorite (Antiformin manufactured by Yoneyama Yakuhin Kogyo Co., Ltd., effective chlorine concentration of approximately 10%) were weighed relative to 100 parts by mass of carbon black (trade name: MA77, manufactured by Mitsubishi Chemical Corporation), and the mixture was diluted by purified water in an amount 4 times that of the mixture (0.2% aqueous solution of sodium hypochlorite) and placed in a beaker. Subsequently, the mixture was stirred in room temperature for 3 hours and, after ending reaction, filtered and washed with water. Warm water in an amount 10 times that of the carbon black was used for the water washing, and the water washing and filtration were repeated at least twice. Subsequently, the mixture was dried at 130° C. for 24 hours to obtain carbon black 10B. A measurement of surface elements of the obtained carbon black 10B resulted in a detected peak derived from chlorine. Physical properties of carbon black 10B were as shown in Table 6.

<Binder resin 1B>

| | |
|---|---|
| Bisphenol A ethylene oxide (2.1 mol) adduct (BPA-EO) | 40 parts by mass |
| Terephthalic acid (TFA) | 40 parts by mass |
| Tetra-butyl titanate (TNBT) | 0.2 parts by mass |

The materials listed above were prepared and reacted for 10 hours while distilling out produced water in a nitrogen gas stream at 220° C. Next, after reaction under reduced pressure of at least 5 mmHg and not more than 20 mmHg, the mixture was cooled to 180° C. and 20 parts by mass of trimellitic anhydride (TMA) were added thereto, sealed under normal pressure and extracted after reaction for 2 hours, then cooled to room temperature and subsequently pulverized to obtain polyester resin. The obtained polyester resin was dissolved in THF to attain 50% by mass of the polyester resin to obtain a binder resin 1B with a weight-average molecular weight of Mw 11,000 and an acid value of 20 mg KOH/g.

<Binder Resins 2B to 4B>

With the exception of altering a raw material ratio as shown in Table 7, binder resins 2B to 4B were obtained in a similar manner to binder resin 1B. Various physical properties of the obtained binder resins were as shown in Table 7.

<Binder Resin 5B>

| | |
|---|---|
| Styrene | 80 parts by mass |
| n-butyl acrylate | 15 parts by mass |
| Monobutyl maleate | 5 parts by mass |
| Di-t-butyl peroxide | 1 part by mass |

The materials listed above were delivered by drops into 200 parts by mass of xylene over 4 hours. In addition, polymerization was completed under reflux of xylene. Subsequently, the temperature was raised to distill out an organic solvent, and the mixture was cooled to room temperature and then pulverized to obtain binder resin 5B with a weight-average molecular weight of Mw 10,500 and an acid value of 5 mg KOH/g.

<Toner Particle Dispersing Agents 1B to 4B>

Toner particle dispersing agents 1B to 4B used in the example and comparative examples are shown in Table 8.

<Synthesis of Pigment Dispersing Agent B>

100 parts of a toluene solution (with a solid content of 50%) of a polycarbodiimide compound having an isocyanate group and having a carbodiimide equivalent of 262 and 8.5 parts of N-methyl diethanolamine were prepared and held for 3 hours at approximately 100° C. to cause the isocyanate group to react with a hydroxyl group. Next, 39.6 parts of an ε-caprolactone self-polycondensate having a carboxyl group at its terminal and having a number-average molecular weight of 8500 were prepared and, after being held for 2 hours at approximately 80° C. to cause a carbodiimide group to react with the carboxyl group, toluene was distilled out under reduced pressure to obtain a pigment dispersing agent B (with a solid content of 100%) with a number-average molecular weight of approximately 13,000.

<Liquid Developer 1B>

| | |
|---|---|
| Carbon black 1B: | 10 parts by mass |
| Pigment dispersing agent B described above: | 10 parts by mass |
| Tetrahydrofuran (THF): | 80 parts by mass |

were mixed, the mixture was stirred for 1 hour with a paint shaker using glass beads with a diameter of 2 mm to obtain a pigment-dispersed slurry 1B,

| | |
|---|---|
| Pigment-dispersed slurry 1B: | 60 parts by mass |
| Binder resin 1B: | 80 parts by mass |
| Toner particle dispersing agent 1B: | 12 parts by mass |

were subsequently mixed by a high-speed disperser (T. K. Robomics with T. K. Homogenizing Disper Model 2.5 blade, manufactured by PRIMIX Corporation) by stirring at 40° C. to obtain a pigment-dispersed solution 1B.

200 parts by mass of dodecyl vinyl ether (DDVE) were gradually added to the pigment-dispersed solution 1B (100 parts by mass) obtained above while stirring at high speed (number of revolutions: 15,000 rpm) using a homogenizer (Ultra-Turrax T50, manufactured by IKA Works, Inc.) to obtain a mixed liquid 1B.

The obtained mixed liquid 1B was transferred to a recovery flask and subjected to ultrasonic dispersion at 50° C. to completely distill out THF to obtain a toner particle dispersion 1B in which a toner particle is contained in a curable insulating liquid.

The obtained toner particle dispersion 1B (10 parts by mass) was subjected to a centrifugal separation process, a supernatant was removed by decantation and replaced with new DDVE with a same mass as the removed supernatant, and the toner particle dispersion 1B was then redispersed.

Subsequently, 0.10 parts by mass of hydrogenated lecithin (trade name: Lecinol S-10, manufactured by Nikko Chemicals Co., Ltd.), 90 parts by mass of DDVE as a carrier liquid, photopolymerization initiators (0.30 parts by mass of trade name "NHNI-PFBS" manufactured by Toyo Gosei Co., Ltd.), and 1 part by mass of trade name "KAYACURE-DETX-S" (manufactured by Nippon Kayaku Co., Ltd.) were added to obtain a liquid developer 1B.

The toner particle contained in the obtained toner particle dispersion had a volume median diameter D50 of 0.7 μm and a volume-equivalent 5% cumulative mean diameter D5 of 0.3 μm.

<Liquid Developers 2B to 8B and 14B to 18B>

With the exception of altering carbon black, a binder resin, a toner particle dispersing agent, and a carrier liquid as shown in Table 9, liquid developers 2B to 8B and 14B to 18B were obtained in a similar manner to the liquid developer 1B. Various physical properties were as shown in Table 9.

<Liquid Developer 9B>

| | |
|---|---|
| Pigment-dispersed slurry 1B described above: | 60 parts by mass |
| Bisphenol A ethylene oxide (2.1 mol) adduct: | 40 parts by mass |
| Terephthalic acid (TFA): | 40 parts by mass |
| Tetra-butyl titanate (TNBT): | 0.2 parts by mass |
| Toner particle dispersing agent 4B: | 12 parts by mass |
| Polymerization initiator 2,2'-azobis (2,4-dimethylvaleronitrile): | 10 parts by mass |
| Ion-exchanged water: | 332 parts by mass |
| $Na_3PO_4 \cdot 12H_2O$: | 5 parts by mass |

were stirred for 15 minutes at 4500 rpm using Clearmix (manufactured by M Technique Co., Ltd.) at 60° C. in an $N_2$ atmosphere to granulate a polymerizable monomer composition. A granulation liquid of the polymerizable monomer composition was placed in a polymerization vessel, and temperature was raised to 70° C. while stirring the granulation liquid with a Fullzone stirring blade (manufactured by Kobelco Eco-Solutions Co., Ltd.) to allow the granulation liquid to react for 10 hours. After the polymerization reaction, saturated vapor (pure steam, steam pressure: 205 kPa, temperature: 120° C.) was introduced while continuing stirring with the Fullzone stirring blade.

A distillate fraction started to emerge when the temperature of contents of the vessel reached 100° C. By performing a heat treatment for 240 minutes at 100° C. until a desired amount of the distillate fraction was obtained, the heat treatment was performed while distilling out residual monomers. After the heat treatment, cooling was performed at a rate of 0.5° C. per minute from 100° C. Once the temperature reached 64.0° C., a heat treatment was performed for 180 minutes while controlling the temperature to have a temperature variation range of 2.0° C. centered at 64.0° C. Subsequently, cooling was performed at a rate of 0.25° C. per minute down to 30° C. Hydrochloric acid was added to the obtained toner particle-dispersed solution, the mixture was stirred and, after dissolving $Ca_3(PO_4)_2$ covering the toner particle, solid-liquid separation was performed using a pressure filtration device to obtain a toner cake. The toner cake was put into water and stirred to be once again made into a dispersed solution, and solid-liquid separation was performed using the filtration device described above. After repetitively performing redispersion of a toner cake into water and solid-liquid separation until $Ca_3(PO_4)_2$ was sufficiently removed, solid-liquid separation was performed one last time to obtain a toner cake.

The obtained toner cake was dried using a flash dryer "Flash Jet Dryer" (manufactured by Seishin Enterprise Co., Ltd.) to obtain a toner particle. Drying conditions included an injection temperature of 90° C. and a dryer outlet temperature of 40° C., and a supply rate of the toner cake was adjusted to a rate which prevented the outlet temperature from deviating from 40° C. in accordance with a moisture content of the toner cake.

The obtained toner particle and 200 parts by mass of dodecyl vinyl ether (DDVE) were transferred to a recovery flask and subjected to ultrasonic dispersion at 50° C. to completely distill out THF to obtain a toner particle dispersion 9B in which the toner particle is contained in liquid. In the toner particle dispersion 9B, the binder resin had an acid value of 20 mg KOH/g.

The obtained toner particle dispersion 9B (10 parts by mass) was subjected to a centrifugal separation process, a supernatant was removed by decantation and replaced with new DDVE with a same mass as the removed supernatant, and the toner particle dispersion 9B was then redispersed.

Subsequently, 0.10 parts by mass of hydrogenated lecithin (trade name: Lecinol S-10, manufactured by Nikko Chemicals Co., Ltd.), 90 parts by mass of DDVE as a carrier liquid, photopolymerization initiators (0.30 parts by mass of trade name "NHNI-PFBS" manufactured by Toyo Gosei Co., Ltd.), and 1 part by mass of trade name "KAYACURE-DETX-S" (manufactured by Nippon Kayaku Co., Ltd.) were added to obtain a liquid developer 9B.

The toner particle contained in the obtained toner particle dispersion had a volume median diameter D50 of 0.5 μm and a volume-equivalent 5% cumulative mean diameter D5 of 0.2 μm.

<Liquid Developers 10B to 13B>

With the exception of altering carbon black and a toner particle dispersing agent as shown in Table 9, liquid developers 11B to 13B were obtained in a similar manner to the liquid developer 9B. In addition, a liquid developer 10B was obtained in a similar manner to the liquid developer 9B with the exception of changing the number of revolutions of the homogenizer to 24,000 rpm. Various physical properties were as shown in Table 9.

Example 1B

The following assessment was performed using the liquid developer 1B.

(Developing Performance)

Development of the liquid developer 1B was performed using the image forming apparatus shown in the drawing by the method described below and the propriety of an obtained image was confirmed.

Reference numerals used in the drawing are as follows. 10: photosensitive drum, 11: charger, 12: exposure device, 13: developing roller, 14: squeegee roller, 15: supplying roller, 16: developing liquid tank, 17: intermediate transfer roller, 18: secondary transfer roller, 19: curing lamp, 20: medium, and 21: cleaning blade.

(1) In a non-contact state where the developing roller 13, the photosensitive drum 10, and the intermediate transfer roller 17 are separated from each other, the developing roller 13, the photosensitive drum 10, and the intermediate transfer roller 17 were differentially driven in directions of arrows shown in the drawing. The rotational speed at this point was set to 250 mm/sec.

(2) The developing roller 13 and the photosensitive drum 10 were brought into contact with each other by a pressing force of 5 N/cm and a bias was set using a DC power supply. A developing bias was set to 200 V.

(3) The photosensitive drum 10 and the intermediate transfer roller 17 were brought into contact with each other by a constant pressing force and a bias was set using a DC power supply. A transfer bias was set to 1000 V.

(4) The intermediate transfer roller 17 and the secondary transfer roller 18 were brought into contact with each other by a constant pressing force and a bias was set using a DC power supply. A transfer bias was set to 1000 V.

(5) A developing liquid with uniform concentration (toner particle concentration: 2%) and in a uniform amount (100 ml) was supplied to a developing liquid tank, an image was formed using a polyethylene terephthalate sheet (manufactured by Teijin Limited, Panlite PC-2151, thickness: 0.3 mm) as a medium 20, and the formed image was assessed.

(Image Density)

Propriety of the image was visually checked.

A (very favorable): density is at least 1.5

B (favorable): density is at least 1.3 and less than 1.5

C (fair): density is at least 1.1 and less than 1.3

D (low density): density is less than 1.1

(Image Density Non-Uniformity)

Image density non-uniformity of the image was visually checked.

A: very favorable

B: favorable

C: slight image density non-uniformity is observed

D: noticeable image density non-uniformity (Cleaning Performance)

A transparent tape (Superstick, manufactured by Lintec Corporation) was applied to a cleaning blade after development to collect a sample adhered to the cleaning blade. Subsequently, the transparent tape with the sample adhered thereto was applied to a sheet of ordinary paper, and the reflectance was measured by a reflectometer TC-6DS (manufactured by Tokyo Denshoku CO., LTD.) mounted with a green filter. Cleaning performance was assessed by subtracting the reflectance of the transparent tape with the sample adhered thereto attached onto the ordinary paper from the reflectance of an unused transparent tape attached onto an ordinary paper. Assessment criteria were as follows.

A: less than 0.5%

B: at least 0.5% and less than 2.0%

C: at least 2.0%

A test result of Example 1B is shown in Table 10.

Examples 2B to 11B

Examples 2B to 11B were assessed in a similar manner to the Example 1B with the exception of altering the liquid developer as shown in Table 10. Assessment results were as shown in Table 10.

Comparative Examples 1B to 7B

Comparative examples 1B to 7B were assessed in a similar manner to the Example 1B with the exception of altering the liquid developer as shown in Table 10. Assessment results were as shown in Table 10.

The results shown in Table 10 reveal that liquid developers with favorable density, image non-uniformity, and cleaning performance are obtained in the examples according to the present invention in comparison with the comparative examples 1B to 7B which represent conventional art.

TABLE 6

| Carbon black No. | Heat treatment temperature/ ° C. | Element content on surface/% Group 15 | Group 16 | Group 17 | Lattice spacing of graphite (002) plane/ nm |
|---|---|---|---|---|---|
| 1B | 2500 | 0.0 | 0.0 | 0.0 | 0.3400 |
| 2B | 3000 | 0.0 | 0.0 | 0.1 | 0.3400 |
| 3B | 2200 | 0.0 | 0.1 | 0.1 | 0.3400 |
| 4B | 2000 | 0.1 | 0.1 | 0.1 | 0.3370 |
| 5B | 1500 | 0.1 | 0.1 | 0.1 | 0.3450 |
| 6B | 1500 | 0.1 | 0.1 | 0.1 | 0.3550 |
| 7B | 1500 | 0.0 | 3.5 | 0.0 | 0.3600 |
| 8B | — | 2.0 | 0.0 | 20.0 | 0.3600 |
| 9B | — | 2.0 | 1.5 | 0.0 | 0.3600 |
| 10B | — | 0.0 | 1.3 | 3.0 | 0.3600 |

TABLE 7

| Binder resin No. | BPA-EO/ parts | TFA/ parts | TMA/ parts | TNBT/ parts | Weight-average molecular weight Mw | Acid value (mgKOH/g) |
|---|---|---|---|---|---|---|
| 1B | 40 | 40 | 20 | 0.2 | 11000 | 20 |
| 2B | 50 | 30 | 20 | 0.2 | 15000 | 5 |
| 3B | 60 | 35 | 5 | 0.2 | 9000 | 1 |
| 4B | 30 | 25 | 45 | 0.2 | 8000 | 51 |

TABLE 10-continued

| Example No. | Liquid developer No. | Developing performance | | Cleaning performance |
|---|---|---|---|---|
| | | Density | Image non-uniformity | |
| Comparative 4B | 15B | D | B | C |
| Comparative 5B | 16B | A | D | A |
| Comparative 6B | 17B | A | D | A |
| Comparative 7B | 18B | A | D | A |

TABLE 8

| Toner particle dispersing agent No. | Trade name | Manufacturer | Acid-base | Amino group |
|---|---|---|---|---|
| 1B | Ajisper PB817 | Ajinomoto Fine-Techno Co., Inc. | Basic | Present |
| 2B | Solsperse 13940 | Lubrizol Japan Limited | Basic | Present |
| 3B | Solsperse 36000 | Lubrizol Japan Limited | Acidic | Absent |
| 4B | KF-2001 | Shin-Etsu Chemical Co., Ltd. | Basic | Absent |

TABLE 9

| Liquid developer No. | Material type | | | | Volume median diameter D50/ μm | 5% cumulative mean diameter D5/μm |
|---|---|---|---|---|---|---|
| | Binder resin No. | Toner particle dispersing agent No. | Carbon black No. | Carrier | | |
| 1B | 1B | 1B | 1B | DDVE | 0.7 | 0.3 |
| 2B | 5B | 1B | 1B | DDVE | 0.7 | 0.3 |
| 3B | 1B | 1B | 1B | Trimethylolpropane trivinyl ether | 0.7 | 0.3 |
| 4B | 1B | 2B | 2B | DDVE | 0.7 | 0.3 |
| 5B | 1B | 2B | 3B | DDVE | 0.7 | 0.3 |
| 6B | 1B | 2B | 4B | DDVE | 0.7 | 0.3 |
| 7B | 1B | 2B | 5B | DDVE | 0.7 | 0.3 |
| 8B | 1B | 2B | 6B | DDVE | 1.5 | 0.5 |
| 9B | See | 4B | 6B | DDVE | 0.5 | 0.2 |
| 10B | specification | 4B | 6B | DDVE | 1.8 | 0.5 |
| 11B | | 4B | 6B | DDVE | 0.4 | 0.1 |
| 12B | | 4B | 7B | DDVE | 0.7 | 0.1 |
| 13B | | 1B | 8B | DDVE | 0.7 | 0.1 |
| 14B | 1B | 1B | 9B | DDVE | 0.7 | 0.1 |
| 15B | 1B | 1B | 10B | DDVE | 0.7 | 0.1 |
| 16B | 1B | 3B | 1B | DDVE | 0.7 | 0.3 |
| 17B | 3B | 1B | 1B | DDVE | 0.7 | 0.3 |
| 18B | 4B | 1B | 1B | DDVE | 0.7 | 0.3 |

TABLE 10

| Example No. | Liquid developer No. | Developing performance | | Cleaning performance |
|---|---|---|---|---|
| | | Density | Image non-uniformity | |
| 1B | 1B | A | A | A |
| 2B | 2B | A | A | A |
| 3B | 3B | A | A | A |
| 4B | 4B | A | A | A |
| 5B | 5B | A | A | A |
| 6B | 6B | A | A | A |
| 7B | 7B | B | A | A |
| 8B | 8B | B | B | A |
| 9B | 9B | B | C | A |
| 10B | 10B | C | C | A |
| 11B | 11B | C | C | B |
| Comparative 1B | 12B | D | B | C |
| Comparative 2B | 13B | D | B | C |
| Comparative 3B | 14B | D | B | C |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-127028, filed Jun. 27, 2016, and Japanese Patent Application No. 2016-127032, filed Jun. 27, 2016, which are hereby incorporated by reference herein in their entirety.

What is claimed is:

1. A liquid developer comprising:

a toner particle containing a binder resin and a carbon black, a toner particle dispersing agent, and a carrier liquid, wherein the carbon black is a graphitized carbon black, and amounts of group 15 elements, group 16 elements, and group 17 elements on a surface of the carbon black are respectively 0.1 atomic percent or less with respect to a total amount of elements on the carbon black surface.

2. The liquid developer according to claim 1, wherein an acid value of the binder resin is 5 to 50 mg KOH/g, and the toner particle dispersing agent is a basic dispersing agent.

3. The liquid developer according to claim 1, wherein the carbon black is a graphitized carbon black with a lattice spacing of a graphite (002) plane as measured by X-ray diffraction of 0.3370 to 0.3450 nm.

* * * * *